US005730653A

United States Patent [19]

Van Becelaere

[11] Patent Number: 5,730,653

[45] Date of Patent: Mar. 24, 1998

[54] COMPACT DAMPER WITH OVER CENTER LATCH

[75] Inventor: Robert M. Van Becelaere, Lake Lotawana, Mo.

[73] Assignee: Tomkins Industries, Inc., Dayton, Ohio

[21] Appl. No.: 626,875

[22] Filed: Apr. 3, 1996

[51] Int. Cl.[6] ..... A62C 2/12

[52] U.S. Cl. ..... 454/369; 454/237

[58] Field of Search ..... 454/369, 237

[56] References Cited

U.S. PATENT DOCUMENTS

| | | | |
|---|---|---|---|
| Re. 30,204 | 2/1980 | Root . | |
| 251,591 | 12/1881 | Jaeger . | |
| 885,008 | 4/1908 | Beard . | |
| 1,270,412 | 6/1918 | Hedrick . | |
| 1,288,532 | 12/1918 | Drummond . | |
| 1,788,556 | 6/1931 | Wood et al. . | |
| 1,994,365 | 3/1935 | Mathews . | |
| 2,496,811 | 2/1950 | Newton . | |
| 2,869,959 | 1/1959 | Kesling . | |
| 3,273,632 | 9/1966 | McCabe . | |
| 3,327,764 | 6/1967 | McCabe . | |
| 3,525,378 | 8/1970 | Root . | |
| 3,543,440 | 12/1970 | Kurz . | |
| 3,640,307 | 2/1972 | Drzala . | |
| 3,695,105 | 10/1972 | Carlson . | |
| 3,718,081 | 2/1973 | Root . | |
| 3,996,952 | 12/1976 | Root | 137/77 |
| 4,432,272 | 2/1984 | Van Becelaere . | |
| 4,559,867 | 12/1985 | Van Becelaere et al. | 98/1 |
| 5,379,792 | 1/1995 | Van Becelaere . | |

*Primary Examiner*—Harold Joyce
*Assistant Examiner*—Derek S. Boles
*Attorney, Agent, or Firm*—Litman, McMahon & Brown L.L.C.

[57] ABSTRACT

An adjustable damper for controlling air flow between portions of a building includes a plurality of vanes positioned in a frame opening, which vanes are selectively, simultaneously rotatable between open and closed positions. A reversible motor and an actuating linkage on one side of the damper drives a first vane axle about an axis, and a vane linkage on the opposite side, rotates the other vanes along with the first vane. The actuating linkage includes a shaft which is offset from the first vane axis, which shaft is turned by the motor between open and closed positions. A linkage arm pivotally connects the shaft and the vane axle and the linkage arm is bent at an angle such that, when the shaft is rotated to the closed position, the linkage arm is rotated to an over center position in which it securely latches the vanes in a closed position. The latch is thus automatically secured when the motor rotates the shaft to the closed position and automatically released when the motor rotates the shaft away from the closed position.

13 Claims, 3 Drawing Sheets

7.
4.
5
3.
7
2
23
24
25
55
54
61
62
53
52
51
104
3.
7.
6
4.

104
91
94
103
102
81
84
95
75
105
85
92
82
83
93
71
72
74
66
64
61
55
73
62
63
65

Fig.3.
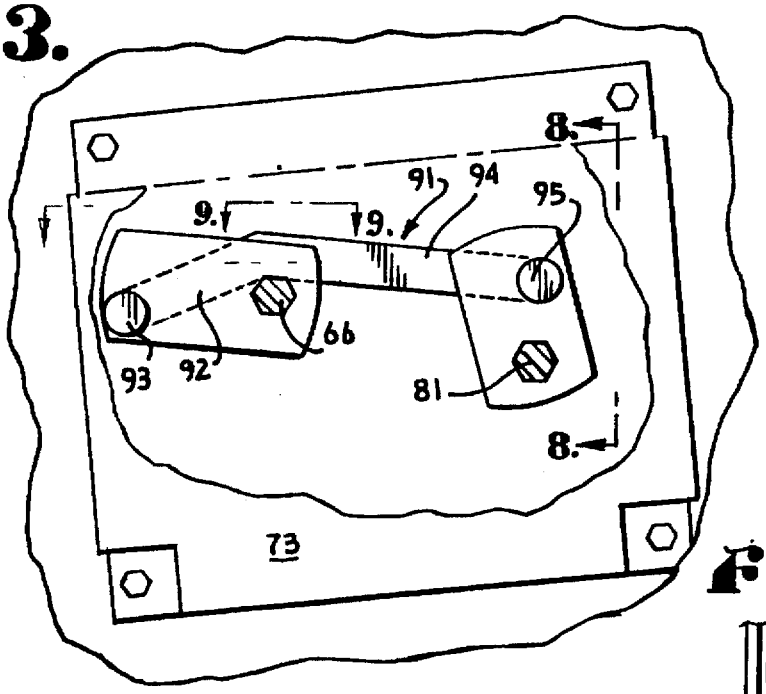
Fig.9.
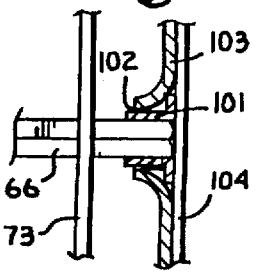
Fig.4.
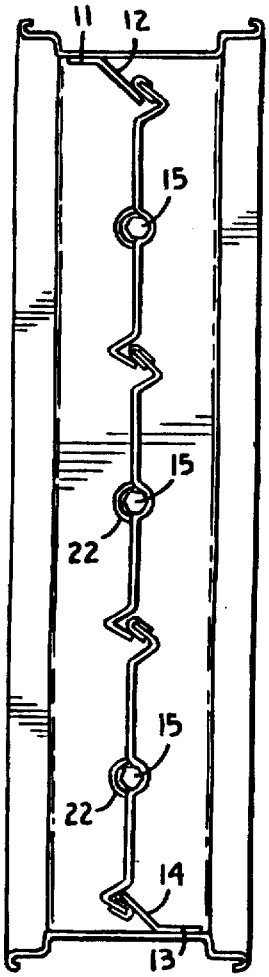
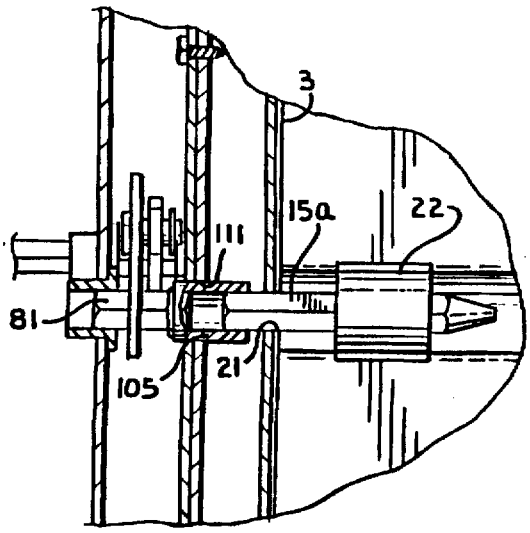
Fig.8.

COMPACT DAMPER WITH OVER CENTER LATCH

FIELD OF THE INVENTION

The present invention relates to a compact adjustable damper such as those used to selectively control air flow into and out of a portion of a building, such as, for example, between a hotel hallway and a hotel room, in the event of fire or smoke. More particularly, the inventive damper includes an opening with a plurality of selectively rotatable blades or vanes positioned therein. The vanes can be rotated by a motor and connected linkage between a vertical, or closed position, at which they collectively block air flow through the opening, and a horizontal, or open position, at which they allow maximum air flow through the opening. When the blades are rotated to the closed position, an over center latch keeps them closed to prevent torsional effects from, for example, the explosive effects of a fire within the building, high pressure water from fire fighting equipment, etc. from opening the vanes.

BACKGROUND OF THE INVENTION

In many modern buildings, such as hotels and the like, fire codes require air flow control dampers to be placed in certain locations, such as between a hotel hallway and a hotel room. Such dampers are generally responsive to a smoke or fire detector to operate a motor and linkage to close off the damper. U.S. Pat. No. RE.30,204 ("the '204 patent") to James R. Root and entitled CONTROL DAMPER teaches one example of a prior art damper. Dampers such as described in the '204 patent include a generally rectangular frame designed for building into a wall. Within the rectangular frame, which defines an opening, a plurality of axles extend inward into the opening from either side. Each axle is selectively rotatable and each pair of axles has attached thereto a respective vane such that the vanes are selectively rotatable with the axles between a vertically oriented, completely closed position at which no air flow is allowed, and a horizontally oriented, completely open position at which maximum air flow is allowed. Between these extreme positions are an infinite number of intermediate, partially open positions.

In order to meet fire code regulations and to gain approval from testing agencies such as Underwriter's Laboratories, such smoke and fire dampers must be latched upon closure to prevent explosive effects of a fire or high pressure water streams, for example, from opening the vanes. In the '204 patent, a latch mechanism includes a fusible portion which melts under high temperature conditions and latches the vanes closed.

A problem with dampers such as that described in the '204 patent is that the fusibly linked latching mechanism requires high temperature conditions for its operation and, once melted, requires replacement of the fusible link or the damper itself. Thus, no positive latching mechanism is provided absent the presence of a high temperature fire. In addition, the '201 patent uses an operating motor and linkage which requires the motor to be positioned approximately 4"–6" away from the damper frame for adequate operating leverage. This substantially increases the overall depth of the damper.

It is clear then, that a need exists for an improved smoke and fire damper with movable vanes and an effective latching mechanism which causes the vanes to be reliably maintained in a closed position. The latch should be effective without melting a fusible link and should latch the vanes closed against the torsional effects of external forces acting on them. The latching mechanism should automatically unlatch as the vanes are opened and then latch as the vanes are closed. Finally, a more compact design of damper would be desirable as well.

SUMMARY OF THE INVENTION

The present invention is directed to an adjustable damper for controlling air flow between portions of a building. The damper includes a rectangular frame forming an opening with a number of selectively rotatable axles extending from either side of the frame into the opening. A plurality of vanes are attached to respective pairs of the axles and each vane preferably is made of a flat plate bent symmetrically with opposite facing angled ends. The vanes can be made of steel plates, for example. A driven axle on one side of the frame is selectively rotated via a motor and connected actuating linkage to thereby rotate a first of the vanes and the corresponding axle on the opposing side of the frame. The axles on the opposing side of the frame are connected to a common linkage such that they rotate simultaneously with the first vane, causing their respective vanes to rotate as well. All of the vanes are thus simultaneously opened or closed together by action of the motor. The motor linkage includes a first shaft which is offset from the driven axle, which first shaft is turned by the motor via a drive shaft and lever arm. A first plate is fixedly secured to the first shaft to rotate therewith and a second plate is fixedly secured to a second shaft which is, in turn, connected to the driven axle. A linkage arm is pivotally connected at one end to the first plate at a first pivot point and at a second end to the second plate at a second pivot point. In a first, closed position of the damper, the first shaft is rotated to a first, closed position such that it causes the first plate, the linkage arm, and the second plate to fully close the vanes by rotating the driven axle and connected vane to a vertical position. In a second, open position of the damper, the first shaft is rotated to a second, open position such that it causes the first plate, the linkage arm, and the second plate to fully open the vanes by rotating the driven axle and connected vane to a horizontal position.

The linkage arm includes a first and a second leg which intersect at an angle such that, when the first shaft is rotated to the closed position, the first plate pulls the linkage arm over the top of the first shaft. The angle in the linkage arm allows the first pivot point to be pulled lower than the axes of the first shaft and the second pivot point, thus creating an over center condition for the linkage arm. In this over center condition, any forces acting on the second plate, such as those created by torsional forces on the vanes, cannot force the linkage arm to move. Thus, when the first shaft is rotated to the closed position, the relative positions of the first and second pivot point and the first shaft axes act as an over center latch mechanism to insure that forces acting on the vanes cannot force the damper open. Furthermore, the latch is automatically secured when the motor rotates the first shaft to the closed position and automatically released when the motor rotates the first shaft away from the closed position. The offset of the first shaft and the driven axle also allows the actuating motor to be placed immediately adjacent to the frame which insures a relatively narrow and compact damper design.

OBJECTS AND ADVANTAGES OF THE INVENTION

The principal objects of the present invention include: providing an improved damper with an over center latch;

providing such a damper with selectively rotatable vanes which, collectively, alternatively, close off or open up air flow through the damper; providing such a damper with an over center latch which automatically latches the vanes closed when they are rotated to the closed position and automatically unlatches to release the vanes as they are rotated away from the closed position; providing such a damper with a compact, narrow profile design; providing such a damper which is rugged in construction and reliable and durable in operation; and providing such a damper which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is an enlarged, fragmentary, cross sectional view of the damper, taken along line 3—3 of FIG. 1, with portions of a cover plate broken away to illustrate the over center latch in a latched position.

FIG. 4 is a cross sectional view of the damper, taken along line 4—4 of FIG. 1, and illustrating the rotatable vanes in a closed position.

FIG. 8 is an enlarged, fragmentary, cross sectional view of a portion of the damper, taken along line 8—8 of FIG. 3, with portions of a rotary sleeve broken away to illustrate the interior construction thereof.

FIG. 9 is an enlarged, fragmentary, cross sectional view of a portion of the damper, taken along line 9—9 of FIG. 3, with a first shaft inserted in a rotary sleeve and with portions of the rotary sleeve and a sleeve pocket broken away to illustrate the interior construction thereof.

DETAILED DESCRIPTION OF THE INVENTION

Figure 1:
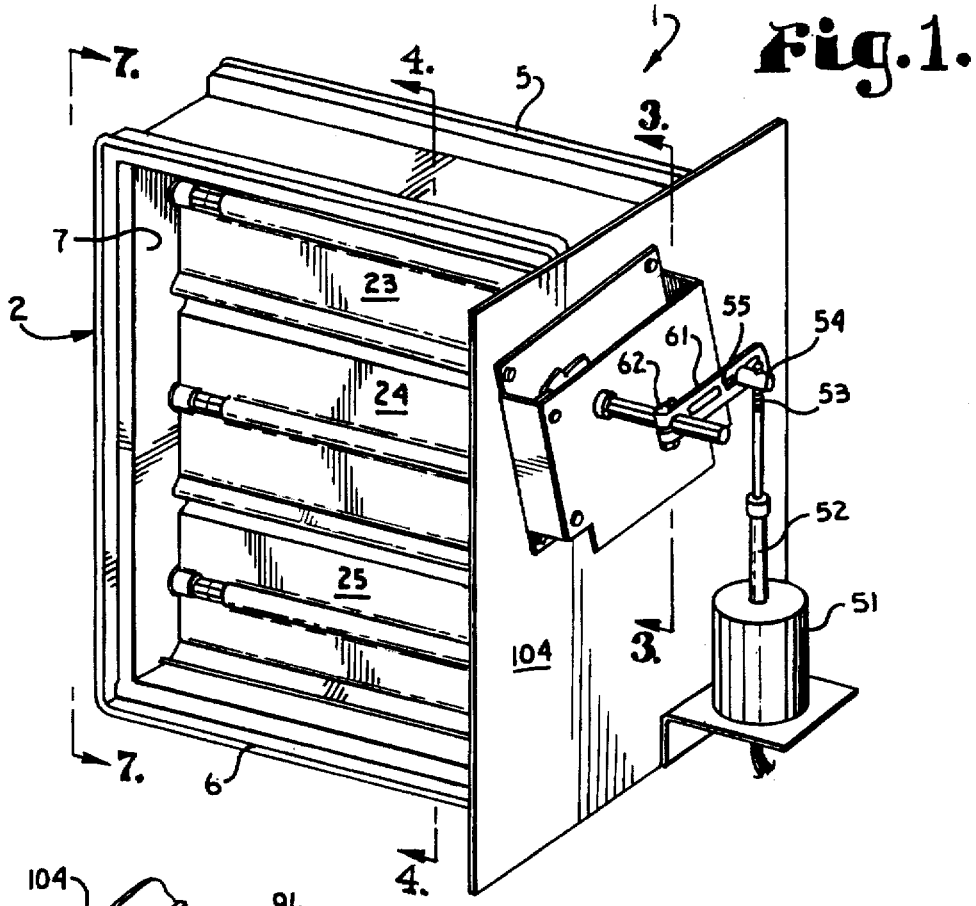
FIG. 1 is a perspective view of a damper with over center latch in accordance with the present invention, with selectively rotatable vanes closed to block air flow therethrough.
Figure 2:
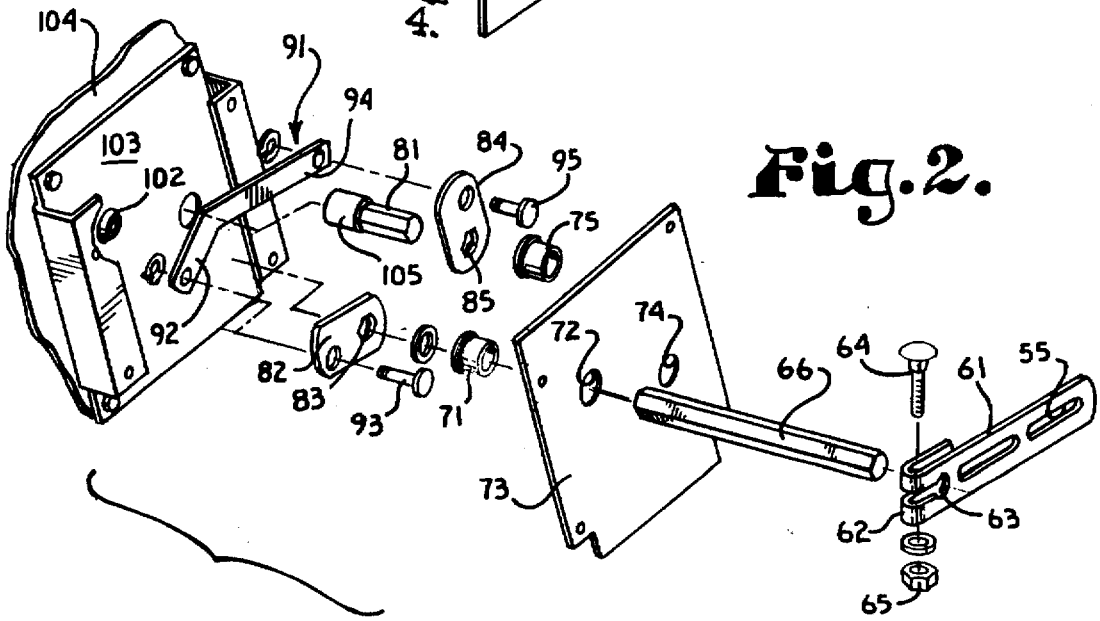
FIG. 2 is an enlarged, fragmentary, exploded view of the motor linkage for the damper of FIG. 1, illustrating the construction of the over center latch.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–9, the reference numeral 1 generally indicates a damper in accordance with the present invention. The damper 1 includes a generally rectangular frame 2 which is of a width which will fit within the width of a wall, such as a standard 2×4 or 2×6 stud wall, for example. The exterior of the frame 2 can be slotted along the periphery to facilitate attachment to a framed opening in the wall (not shown). The frame 2 includes side members 3 and 4 and top and bottom members 5 and 6, respectively, which collectively form a rectangular opening 7 in the frame 2. Attached inside the top member 5 is an upper flange 11 with a protruding angled leg 12 while a lower flange 13 is attached inside the bottom frame member 6 with a protruding angled leg 14. A plurality of axles 15 extend inward through bores 21 in the side frame members 3 and 4. The axles 15, which are shown as hexagonal in cross section, are arrayed in pairs opposite each other. Each axle 15 fits within a respective stationary receiving sleeve 22 on one of a plurality of rotatable vanes 23–25. The receiving sleeves 22 have an interior shape which secures the axles 15 such that the vanes are fixed with respect to the axles 15. The axles 15 are thus rotatable relative to the side frame members 3 and 4, and thus the vanes 23–25 rotate along with the axles 15.

Figure 6:
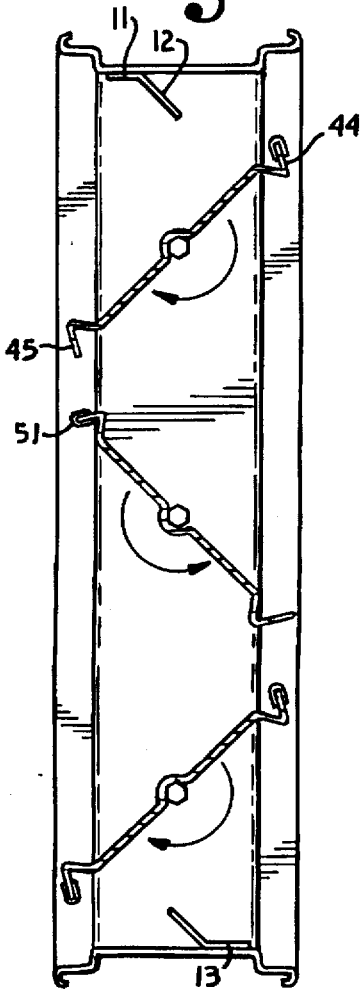
FIG. 6 is a cross sectional view of the damper, taken along line 4—4 of FIG. 1, but illustrating the rotatable vanes rotated to a partially open position.
Figure 7:
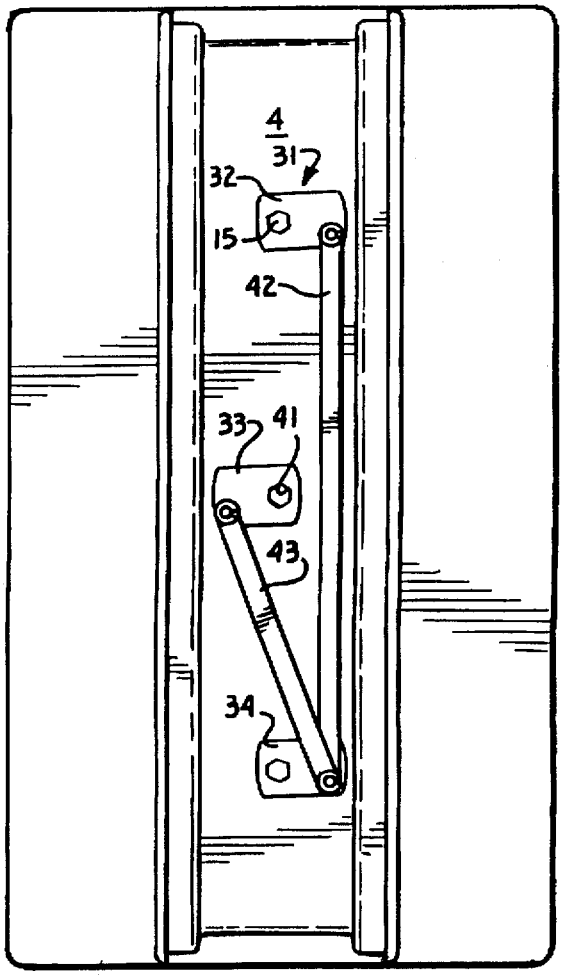
FIG. 7 is a side elevational view of the damper, taken along the line 7—7 of FIG. 1 and illustrating the common linkage which causes the vanes to move simultaneously.

Referring to FIG. 7, a linkage system for simultaneously rotating the vanes 23–25 is generally indicated at 31. The linkage system 31 includes three plates 32–34, each of which has a hexagonal bore 41 sized to receive a respective axle 15 such that the axles 15 and the respective attached plate 32–34 rotate together. A first linkage arm 42 is pivotally connected at an upper end to the plate 32 and at a lower end to the plate 34. A second linkage arm 43 is pivotally connected at a lower end to the plate 34 and at an upper end to the plate 33. The effect of the connection of linkage arms 42 and 43 to the plates 32–34 is that, as any one of the vanes 23–25 rotates, the other vanes are rotated simultaneously. However, the upper and lower vanes 23 and 25 rotate in a direction opposite to the middle vane 24, as indicated by the arrows in FIG. 6.

Referring to FIGS. 4 and 6, each vane 23–25 includes upper and lower angled portions 44 and 45 which are oppositely facing. Although the vanes 24–25 are identical in construction, the upper vane 23 and the middle vane 24 have sealing gaskets 50 placed along their upper angled portions while the lower vane 25 has gaskets 50 placed along both the upper and lower angled portions 44 and 45. Thus, as the vanes 23–25 are rotated from the partially open position illustrated in FIG. 6 to the closed position illustrated in FIG. 4, the upper angled portion 44 of the upper vane 23 meshes with the upper flange 11, the upper angled portion 44 of the middle vane 24 meshes with the lower angled portion 45 of the upper vane 23, the lower angled portion 45 of the middle vane 24 meshes with the upper angled portion 44 of the lower vane 25, and the lower angled portion 45 of the lower vane 25 meshes with the lower flange 13. The vanes 23–25 and the upper and lower flanges 11 and 13, respectively, collectively seal off air flow through the opening 7 in the damper 1.

Referring particularly to FIGS. 1–3, 5, 8 and 9, the damper 1 includes a reversible actuating motor 51 which selectively extends and retracts a telescoping drive shaft 52. The motor 51 can be responsive to a fire or smoke alarm (not shown), for example, to extend the drive shaft 52. The shaft 52 has a threaded upper end 53 with a bored sleeve 54 attached thereto. The sleeve 54 is, in turn, connected to and is movable relative to a slot 55 near a first end of a lever arm 61. In the opposite end of the lever arm 61 a clamp 62 is formed with an opening 63. The clamp 62 includes a bolt 64 and nut 65 which, when tightened, clamps down the opening 63 to anchor the lever arm 61 to a first hex shaft 66. The first hex shaft 66 extends through a sleeve 71 which fits in a bore 72 in a protective plate 73. The first hex shaft 66 is thus rotatable within the sleeve 71 by action of the motor 51. A second bore 74 in the plate 73 accommodates a second sleeve 75 with a second hex shaft 81 extending therethrough.

A first plate 82 is connected to the first hex shaft 66 via via a hex shaped opening 83. A second plate 84 is connected to the second hex shaft 81 via a hex shaped opening 85. The plates 82 and 84 thus rotate with their respective hex shafts 66 and 81. A linkage arm 91 is pivotally connected near one end of a first leg 92 to the first plate 82 at a first pivot pin 93. The linkage arm 91 is pivotally attached near one end of a second leg 94 to the second plate 84 at a second pivot pin 95. The linkage arm first leg 92 and the second leg 94 are angled with respect to each other, for reasons explained below.

The opposite end of the first hex shaft 66 is received in and is rotatable relative to a sleeve 101 which is rigidly secured to a stamped out bore 102 in a plate 103 (FIG. 9). The plate 103 is, in turn, attached to a larger cover plate 104 which is attached to the side frame member 3 (FIG. 8). The opposite end of the second hex shaft 81 is rigidly secured within one end of a sleeve 105 while a near end of a driven axle **15*a* is rigidly secured within the opposite end of the sleeve 105. The sleeve 105 is received within and is rotatable relative to a bore 111 extending through the plates 103 and 104. The driven axle 15*a* is connected to one of the receiving sleeves 22 on the upper vane 23 such that the upper vane 23 rotates with the axle 15*a*, the sleeve 105 and the second hex shaft 81**.

Referring to FIGS. 1 and 3, the first hex shaft 66 is shown turned counterclockwise to a closed position, by enabling the motor 51 to extend the telescoping drive shaft 52. In the position shown in FIG. 3, the first plate 82 is also turned counterclockwise to the left until the linkage arm 91 rests on the first hex shaft 66 near the angled intersection between the first and second legs 92 and 94, respectively. With the linkage arm 91 in this position, due to the angle between the first and second legs 92 and 94, the first pivot pin 93 comes to rest in a position in which the axis of the first pivot pin 93 is lower than the axes of the first hex shaft 66 and the second pivot pin 95, i.e. an over center position. In this position, the vanes 23–25 are latched in place because any external torsional forces on the closed vanes 23–25 which tend toward opening the vanes, such as by fire or high pressure water streams, results in a clockwise rotational force translated to the second hex shaft 81. However, the over center position of the linkage arm 91 insures that the second plate 84 cannot be rotated since the linkage arm 91 is being pulled against itself. Thus, the second hex shaft 81 is latched in the position of FIG. 3, keeping the vanes 23–25 also latched in the closed position of FIGS. 1 and 4.

Figure 5:
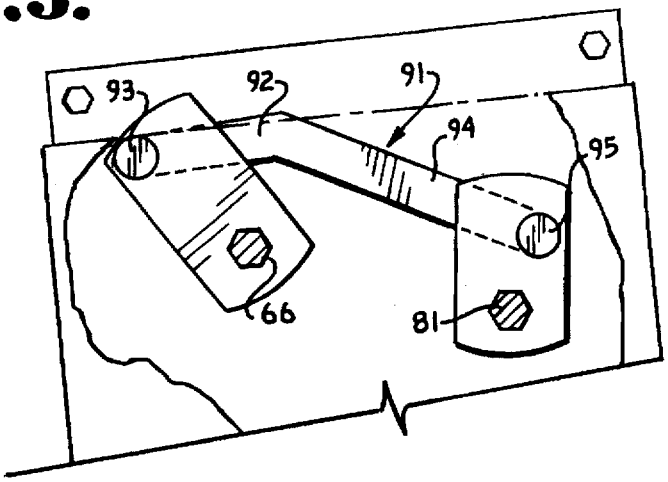
FIG. 5 is an enlarged, fragmentary, cross sectional view of the damper, taken along line 3—3 of FIG. 1, with portions of a cover plate broken away to illustrate the over center latch in an unlatched position.

When the motor 51 retracts the drive shaft 52, the first ex shaft 66 is turned clockwise, as shown in FIG. 5. The linkage arm 91 is thus raised by the first plate 82 to a position in which the axis of the first pivot pin 93 is above the axes of the first hex shaft 66 and the second pivot pin 95. This ends the over center condition and the linkage arm 91 urges the second plate 84 clockwise, turning the driven axle **15*a* clockwise as well. This opens the vanes 23–25, as shown in FIG. 6. When the drive shaft 52 is fully retracted, the vanes 23–25 are placed in a horizontal position which allows maximum air flow through the opening 7 in the damper 1**.

Another advantage of the present invention is the orientation of the lever arm 61 as dictated by the position of the first hex shaft 66. Since the lever arm 61 extends back toward the frame 2, the motor 51 is positioned alongside the side frame member 3. This insures that the damper 1 has as narrow a profile as possible. Of course, the plates 73, 103, and 104 can be made smaller, and even confined within the width of the side frame members 3 and 4 if the lever arm 61 and the linkage arm 91 are shortened, provided the motor 51 is strong enough to actuate the vanes 23–25 with the shortened lever arm 61. The damper 1 could thus be placed entirely within a framed wall.

The inventive damper 1 has been illustrated and described as being of use as a smoke and fire damper, but it would be equally useful in other applications, such as for an external air vent for an HVAC system, for example, or for controlling any opening where fluid flow needs to be regulated. While the damper 1 has been illustrated with vanes 23–25 constructed of flat plates, other shapes, such as airfoil shaped vanes, can be used as well. For use as a fire damper, some type of failsafe closure, such as a combination fusible link and spring closure, shown in the '204 patent, could be incorporated to insure that the vanes 23–25 are rotated to the closed, latched position in the event of fire.

It is thus to be understood that while certain forms of the present invention have been illustrated and described herein, it is not to be limited to the specific forms or arrangement of parts described and shown.

What is claimed and desired to be secured by Letters Patent is as follows:

1. A damper comprising:

a. a frame forming an opening;

b. a first vane in said opening, said first vane being mounted on a first rotatable shaft and being selectively rotatable with said shaft between a closed position substantially blocking at least a portion of said opening and an open position allowing maximum fluid flow through said opening; and c. an operating linkage connected to said first rotatable shaft, said linkage including a one piece rigid, angled linkage arm with first and second angled legs with a first end terminating said first leg and a second end terminating said second leg, which is selectively movable between a closed position at which it moves said first vane to said closed position, and an open position at which it moves said first vane to said open position, said rigid, angled linkage arm first end being above the axis of said first rotatable shaft in said open position and below the axis of said first rotatable shaft in said closed position, said linkage arm assuming an over center, latched condition when in said closed position due to the placement of said first end below the axis of said first rotatable shaft such that said first vane is latched closed.

2. A damper as in claim 1, wherein said operating linkage further comprises:

a. a second rotatable shaft;

b. a first plate connected to rotate with said first shaft, said first plate being pivotally connected to said linkage arm at a first pivot point proximate said first end; and c. a second plate connected to rotate with said second shaft, said second plate being pivotally connected to said linkage arm at a second pivot point proximate said second end such that;

d. as said first rotatable shaft is rotated between first and second positions, said linkage arm is moved between said closed and open positions, respectively, thus rotating said first vane; and e. said first and second legs are oriented at an angle with respect to each other such that, when said linkage arm is in said closed position, said first pivot point is rotated to a lower position than the axes of said first shaft and said second pivot point.

3. A damper as in claim 2, and further comprising:

a. a lever arm with one end connected to said first rotatable shaft;

b. a motor; and c. a drive shaft connected to said motor and being selectively extendable and retractable via said motor, said lever arm having an opposite end connected to said drive shaft such that said second rotatable shaft is selectively caused to rotate between said closed and open positions, respectively, as said drive shaft is extended and retracted.

4. A damper as in claim 3, and wherein:

a. said lever arm is oriented in a plane perpendicular to the rotation axis of said vane; and b. said motor is positioned proximate said frame.

5. A damper as in claim 1, and further comprising:

a. one or more additional vanes in said opening, each of said additional vanes being selectively movable between a closed position substantially blocking a portion of said opening and an open position allowing maximum fluid flow through said opening;

b. a vane linkage system which links said first vane with said additional vanes such that said additional vanes are moved between said closed and open positions simultaneously with said first vane, said first vane and said additional vanes cooperatively blocking off at least a portion of said opening when in said closed position; and wherein c. said over center, latched condition of said linkage arm latches said first vane and said additional vanes closed.

6. A damper comprising:

a. a frame forming an opening;

b. a first vane in said opening, said first vane being selectively movable between a closed position substantially blocking at least a portion of said opening and an open position allowing maximum fluid flow through said opening;

c. an operating linkage connected to said first vane, said operating linkage including:

i. a one piece rigid, angled linkage arm with first and second angled legs with a first end terminating said first leg and a second end terminating said second leg, which is selectively movable between a closed position and an open position;

ii. a first rotatable shaft connected to said vane;

iii. a second rotatable shaft also being selectively movable between a closed position and an open position;

iv. a first plate connected to rotate with said first shaft, said first plate being pivotally connected to said linkage arm proximate said first end at a first pivot point; and v. a second plate connected to rotate with said first shaft, said second plate being pivotally connected to said linkage arm proximate said second end at a second pivot point such that;

d. as said second rotatable shaft is rotated between said closed and said open positions, said linkage arm is moved between said closed and open positions, respectively, with the linkage arm first end being above the axis of said first rotatable shaft in said open position and below the axis of said first rotatable shaft in said closed position, thus rotating said first rotatable shaft, and said connected first vane, between said closed and open positions, said linkage arm assuming an over center, latched condition when in said closed position due to the placement of said first end below the axis of said first rotatable shaft such that said first vane is latched closed.

7. A damper as in claim 6, and further comprising:

a. a lever arm with one end connected to said second rotatable shaft;

b. a motor; and c. a drive shaft connected to said motor and being selectively extendable and retractable via said motor, said lever arm having an opposite end connected to said drive shaft such that said first rotatable shaft is selectively caused to rotate between said closed and open positions as said drive shaft is extended and retracted.

8. A damper as in claim 7, and wherein:

a. said lever arm is oriented in a plane perpendicular to the rotation axis of said vane; and b. said motor is positioned proximate said frame.

9. A damper as in claim 7, and further comprising:

a. one or more additional vanes in said opening, each of said additional vanes being selectively movable between a closed position substantially blocking a portion of said opening and an open position allowing maximum fluid flow through said opening;

b. a vane linkage system which links said first vane with said additional vanes such that said additional vanes are moved between said closed and open positions simultaneously with said first vane, said first vane and said additional vanes cooperatively blocking off at least a portion of said opening when in said closed position; and wherein c. said over center, latched condition of said linkage arm latches said first vane and said additional vanes closed.

10. A damper comprising:

a. a frame forming an opening;

b. a first vane in said opening, said first vane being selectively movable between a closed position substantially blocking at least a portion of said opening and an open position allowing maximum fluid flow through said opening;

c. an operating linkage connected to said first vane, said operating linkage including:

i. a one piece linkage arm being selectively movable between a closed position and an open position, said linkage arm including first and second legs oriented at an angle with respect to each other;

ii. a first rotatable shaft connected to said vane;

iii. a second rotatable shaft also being selectively movable between a closed position and an open position; a second rotatable shaft connected to said first vane;

iv. a first plate connected to rotate with said first shaft, said first plate being pivotally connected to said linkage arm first leg at a first pivot point; and v. a second plate connected to rotate with said first shaft, said second plate being pivotally connected to said linkage arm second leg at a second pivot point such that;

d. as said second rotatable shaft is rotated between closed and open positions, said linkage arm is also moved between said closed and open positions, respectively, thus rotating said first rotatable shaft, and said connected first vane, between said closed and open positions, said linkage arm being oriented such that, when it is in said closed position, said first pivot point is rotated to a position lower than the axes of said first shaft and said first pivot point such that said first vane is latched closed.

11. A damper as in claim 10, and further comprising:

a. a lever arm with one end connected to said second rotatable shaft;

b. a motor; and c. a drive shaft connected to said motor and being selectively extendable and retractable via said motor, said lever arm having an opposite end connected to said drive shaft such that said second rotatable shaft is selectively caused to rotate between said closed and open positions as said drive shaft is extended and retracted, respectively.

12. A damper as in claim 11, and wherein:

a. said lever arm is oriented in a plane perpendicular to the rotation axis of said vane; and b. said motor is positioned proximate said frame.

13. A damper as in claim 10, and further comprising:

a. one or more additional vanes in said opening, each of said additional vanes being selectively movable between a closed position substantially blocking a portion of said opening and an open position allowing maximum fluid flow through said opening;

b. a vane linkage system which links said first vane with said additional vanes such that said additional vanes are moved between said closed and open positions simultaneously with said first vane, said first vane and said additional vanes cooperatively blocking off at least a portion of said opening when in said first position; and wherein c. said over center, latched condition of said linkage arm latches said first vane and said additional vanes closed.

* * * * *